US006089951A

United States Patent [19]

Ostendorff

[11] Patent Number: 6,089,951

[45] Date of Patent: Jul. 18, 2000

[54] TOY VEHICLE AND TRACKSET HAVING LAP-COUNTING FEATURE

[75] Inventor: Eric Ostendorff, Torrance, Calif.

[73] Assignee: Mattel, Inc., El Segundo

[21] Appl. No.: 09/240,443

[22] Filed: Jan. 29, 1999

[51] Int. Cl.[7] ..... A63H 18/14

[52] U.S. Cl. ..... 446/429; 446/409; 446/444; 446/465

[58] Field of Search ..... 446/429, 430, 446/444, 465, 409; 463/59

[56] References Cited

U.S. PATENT DOCUMENTS

| | | | |
|---|---|---|---|
| 3,590,524 | 7/1971 | Beny et al. | 446/429 |
| 3,621,608 | 11/1971 | Bosley et al. . | |
| 3,712,615 | 1/1973 | Staats et al. . | |
| 3,717,952 | 2/1973 | Strongin . | |
| 3,780,470 | 12/1973 | Roberts et al. . | |
| 4,055,021 | 10/1977 | Okamoto . | |
| 4,147,351 | 4/1979 | Saito . | |
| 4,472,905 | 9/1984 | Silverman et al. . | |
| 4,565,537 | 1/1986 | Klimpert et al. . | |
| 4,612,472 | 9/1986 | Kakizaki et al. . | |
| 4,702,718 | 10/1987 | Yanase . | |
| 4,802,879 | 2/1989 | Rissman et al. . | |
| 4,813,907 | 3/1989 | Risssman et al. . | |
| 4,925,188 | 5/1990 | McKay et al. . | |
| 4,925,424 | 5/1990 | Takahashi . | |
| 4,925,427 | 5/1990 | Wu . | |
| 4,946,416 | 8/1990 | Stern et al. . | |
| 4,964,837 | 10/1990 | Collier . | |
| 5,045,016 | 9/1991 | Stern et al. . | |
| 5,130,693 | 7/1992 | Gidandet . | |
| 5,195,920 | 3/1993 | Collier . | |
| 5,512,001 | 4/1996 | Kent et al. . | |
| 5,635,903 | 6/1997 | Koike et al. . | |
| 5,637,996 | 6/1997 | McDarren et al. . | |
| 5,656,907 | 8/1997 | Chainani et al. . | |

*Primary Examiner*—Robert A. Hafer
*Assistant Examiner*—Jeffrey D. Carlson
*Attorney, Agent, or Firm*—Roy A. Ekstrand

[57] ABSTRACT

A toy includes a toy vehicle and a closed loop trackset for guiding the toy vehicle about the track loop. The trackset further includes a booster having one or more rotating disks positioned to grip the toy vehicle and accelerate the vehicle. The toy vehicle supports a momentum sensitive switch and a microprocessor counter and liquid crystal display for responding to each disturbance of the momentum switch to increment the display lap count upon the liquid crystal display. The momentum switch is positioned and configured to respond to the momentum changes imparted to the toy vehicle as the booster accelerates the toy vehicle.

9 Claims, 2 Drawing Sheets

TOY VEHICLE AND TRACKSET HAVING LAP-COUNTING FEATURE

FIELD OF THE INVENTION

This invention relates generally to toy vehicle tracksets and particularly to feature activities provided therewith.

BACKGROUND OF THE INVENTION

Toy vehicle tracksets have enjoyed great popularity for many years. Initially, such toy vehicle tracksets were simply combinations of one or more toy vehicles and a length or loop of guiding track. Vehicles themselves were relatively simple being provided as either free-wheeling vehicles or battery-powered. When free-wheeling vehicles are utilized, some form of energy transfer such as spring launchers or the like was generally provided.

With increased sophistication of related arts and efforts of practitioners in the toy arts to improve their respective products, the complexity and sophistication of toy vehicle tracksets increased. Tracks themselves became more complex with various loops and/or jumps replacing the standard oval track. In addition, various competitive type tracksets developed using multiple lanes and cars to provide a competitive racing feature. Other features such as speed boosters and lap counter stations have also been provided to further increase the play value of such tracksets.

U.S. Pat. No. 3,712,615 issued to Staats, et al. sets forth a MULTIPLE TOY VEHICLE LAP COUNTER having lap counter assembly for use in a toy racing set. A plurality of track lines are provided for a plurality of toy vehicles. At the lap-counting station, a plurality of trip members are located to trigger a lap count event as the vehicles passing through contact the trip member.

U.S. Pat. No. 4,472,905 issued to Silverman, et al. sets forth a TOY VEHICLE WITH TIMING DEVICE having an electronic timing mechanism with an elapsed time display which may be manually started and stopped via a switch when the front end of the vehicle is actuated by an impact against a vertical gate supported in an obstructive manner upon the toy vehicle travel path.

U.S. Pat. No. 4,925,188 issued to McKay, et al. sets forth a TOY RACE TRACK AND LAP COUNTER having a track with adjacent lanes each forming a complete circuit and racing objects propelled around the track by pressurized air. The pressurized air is controllably discharged from separate nozzles in a propulsion tower. The timing and intensity of each air burst determines the energy imparted to the toy vehicle.

U.S. Pat. No. 5,637,996 issued to McDarren, et al. sets forth a TOY SYSTEM WITH MOVABLE VEHICLES having apparatus for measuring the speed of toy vehicles passing through a tunnel-like structure. The system measures the speed of a toy vehicle and reports the speed contemporaneously in audible speech. The system utilizes optical detectors and timing circuitry to compute speed and a voice synthesizer to provide audible indications of speed.

U.S. Pat. No. 4,925,424 issued to Takahashi sets forth a TOY VEHICLE AND TRACK WITH TRACK MOUNTABLE COMMAND SEGMENTS in which each segment defines a detectable motion pattern array which the toy vehicle reads when traversing the command segment. The toy vehicle is self-powered and supports a pattern recognition system.

U.S. Pat. No. 4,925,427 issued to Wu sets forth a CONVERTIBLE TOY CAR HAVING TWO-LEVEL CAM together with a sound assembly, a signal light and a signal light activation arm. The two-level cam includes an upper and lower cam and is driven indirectly by a battery-powered electric motor and gear set. The upper cam drives the projection assembly to project toy figures out of the car doors. The lower cam urges a spring-loaded signal light activation arm to be intermittently rotated into position.

U.S. Pat. No. 4,946,416 issued to Stern, et al. sets forth a VEHICLE WITH ELECTRONIC SOUNDER AND DIRECTION SENSOR in which a speed sensor determines both the speed and direction of travel of the toy vehicle. A sound system within the toy vehicle produces an engine sound in response to the sensed speed.

U.S. Pat. No. 5,130,693 issued to Gigandet sets forth a SOUND EFFECTS GENERATING DEVICE FOR ACTIVITY TOYS OR VEHICLES which automatically generates sound effects and flashing lights in response to the position or tilt of the host vehicle. The device may be attached to the underside of a skateboard between the forward and rearward trucks.

U.S. Pat. No. 4,964,837 and U.S. Pat. No. 5,195,920 (a continuation thereof) each issued to Collier and each entitled RADIO-CONTROLLED MODEL VEHICLE HAVING COORDINATED SOUND EFFECTS SYSTEM sets forth a toy vehicle having an onboard processor and sound system together with radio-controlled apparatus. The processor and sound system cooperate to produce appropriate sounds under different conditions of vehicle operation.

U.S. Pat. No. 5,512,001 issued to Kent, et al. sets forth a TOY VEHICLE having a sound generating mechanism for producing realistic vehicle engine sound and a smoke generating mechanism for simulating smoke vapors and exhaust.

U.S. Pat. No. 5,635,903 issued to Koike, et al. sets forth a SIMULATED SOUND GENERATOR FOR ELECTRIC VEHICLES having a plurality of sensors for determining various operative conditions of the host vehicle. Simulated sound is produced by a sound circuit and is selected in accordance with the detected condition of operation of the vehicle.

U.S. Pat. No. 5,045,016 issued to Stern, et al. sets forth a TOY VEHICLE WITH ELECTRONIC SOUNDER AND DIRECTION SENSOR configured to pushed along by a child user. Electronic circuitry capable of emitting a plurality of different sounds characteristic of trucks is operative to provide appropriate sound effects.

U.S. Pat. Nos. 5,656,907; 3,621,6081; 3,717,952; and 3,780,470 set forth various examples of programmable toy vehicles sharing the common characteristic of preestablishing the travel path of a toy vehicle in accordance with a program.

U.S. Pat. No. 4,055,021 issued to Okamoto sets forth a TOY RACER WITH SELF-STEERING MECHANISM having a trackway supporting an arrangement of retractable arms wherein the arm is operative to switch the toy vehicle between lanes.

U.S. Pat. No. 4,147,351 issued to Saito sets forth a CRASH VAN CHASE having a continuous trackway and guide mechanism for directing vehicles along the trackway. A switching station diverts the vehicles from one lane to another is also provided.

U.S. Pat. No. 4,813,907 issued to Rissman, et al. sets forth a TOY VEHICLE WITH GRAPHICS DISPLAY configured such that the vehicle exhibits animated characteristics upon a liquid crystal display.

U.S. Pat. Nos. 4,702,718; 4,802,879; 4,612,472; and 4,565,537 set forth various toy devices related generally to the present invention device.

While the foregoing prior art devices have improved the art and is some instances enjoyed commercial success, there remains nonetheless a continuing need in the art for ever-more improved, interesting and entertaining toy vehicle trackset products.

SUMMARY OF THE INVENTION

Accordingly, it is a general object of the present invention to provide an improved toy vehicle and trackset. It is a more particular object of the present invention to provide an improved toy vehicle and trackset providing a novel lap-counting feature.

In accordance with the present invention, there is provided a toy vehicle and trackset combination, the vehicle and trackset comprising: a toy vehicle having a chassis and rolling wheels; a momentum switch supported upon the chassis responsive to momentum change forces imparted to the toy vehicle; display means supported by the toy vehicle for displaying a lap count number; circuit means supported by the toy vehicle responsive to the momentum switch for incrementing the lap count number each time the momentum switch is triggered; a trackset having a toy vehicle guiding pathway forming a closed circuit; and a booster within the trackset having means for accelerating the toy vehicle as is passes through the booster, the booster imparting an abrupt momentum change to the toy vehicle to accelerate the toy vehicle and trigger the momentum switch.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
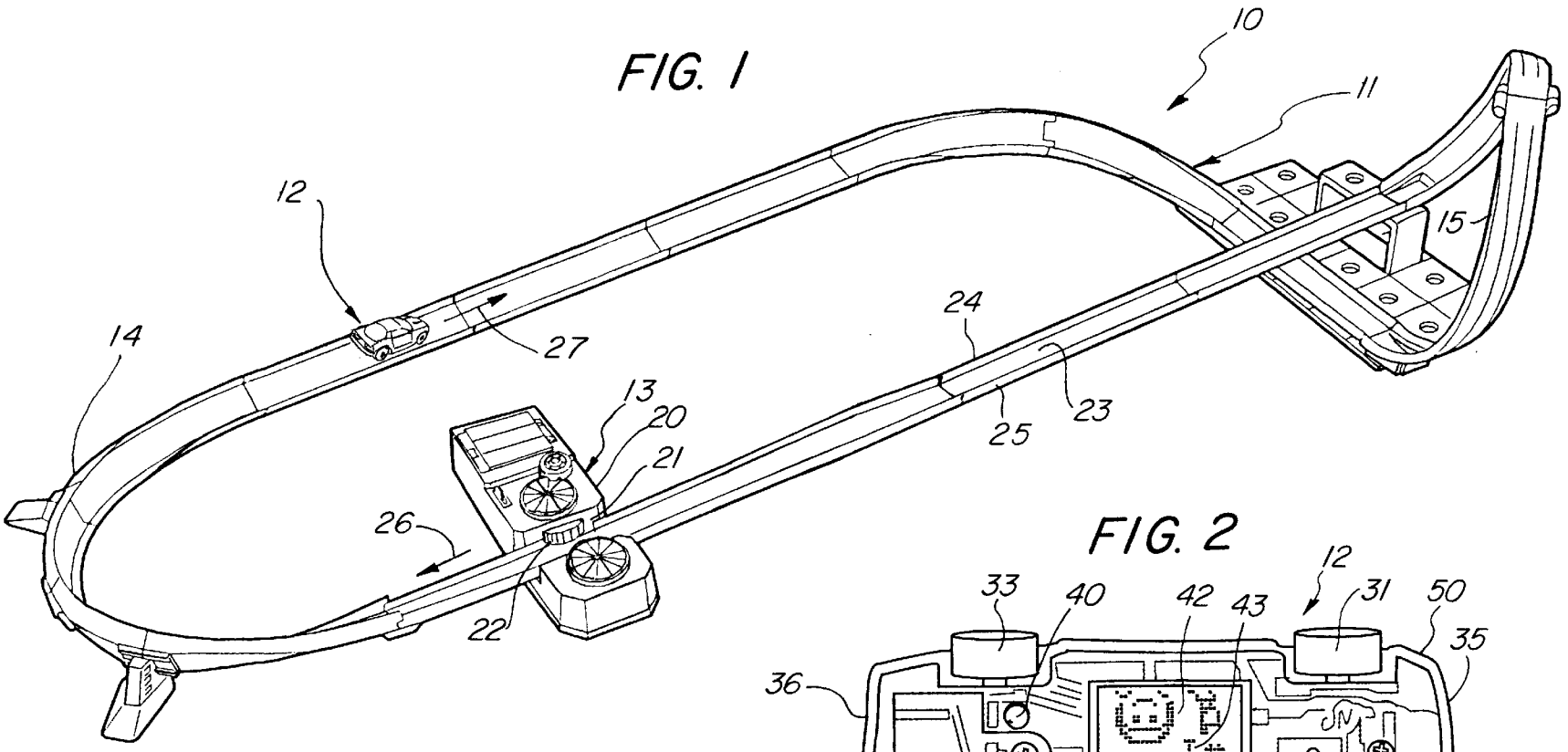
FIG. 1 sets forth a perspective view of a toy vehicle and trackset constructed in accordance with the present invention.

FIG. 1 sets forth a perspective view of a toy constructed in accordance with the present invention and generally referenced by numeral 10. Toy 10 has three major components which are multiply curved trackset 11 forming a continuous loop track, a toy vehicle 12 sized and configured to be movable upon and guided by trackset 11 and a booster 13 positioned upon the travel path of trackset 11. In the general operation of toy 10, toy vehicle 12 repeatedly traverses the continuous loop formed by trackset 11 and passes through booster 13 once each lap. In accordance with conventional fabrication techniques, booster 13 imparts energy to toy vehicle 12 during each pass to facilitate continuous travel of toy vehicle 12 upon trackset 11.

More specifically, trackset 11 is preferably formed of a molded plastic material or the like and may be entirely conventional in fabrication. Trackset 11 is formed to define a path surface 23 having raised sidewalls 24 and 25 on each side thereof. Path 23 and the spacing between side walls 24 and 25 are selected to guide toy vehicle 12 upon path 23 without unduly contacting toy vehicle 12 in an energy absorbing manner.

Booster 13 may be fabricated entirely in accordance with conventional fabrication techniques and includes a housing 20 defining a gap 21 therethrough. A portion of trackset 11 passes through gap 21. In further accordance with conventional fabrication techniques, booster 13 supports a pair of resilient rotatable wheels such as wheel 22 on each side of gap 21. A battery-powered motor driven drive system (not shown) causes the wheels of booster 13 such as wheel 22 to rotate at high speed. Thus, each time toy vehicle 12 enters gap 21 traveling in the direction indicated by arrow 26, the high speed rotation of wheel 22 allows wheel 22 to engage the side surface of toy vehicle 12 and accelerate the toy vehicle in the direction indicated by arrow 26. Once toy vehicle 12 has been accelerated, toy vehicle 12 traverses curve 14 and loop 15 to again return to gap 21 of booster 13. Thereafter, the boosting cycle is repeated for toy vehicle 12. Considering toy vehicle 12 having been boosted through booster 13 in the direction of arrow 26 and having been guided by curve 14 of trackset 11, toy vehicle 12 is shown traveling in the direction indicated by arrow 27. It will be apparent to those skilled in the art that toy vehicle 12 will, at the position shown in FIG. 1, have lost at least a small amount of its kinetic energy. However, in accordance with the anticipated fabrication of the present invention, booster 13 will impart sufficient energy to toy vehicle 12 to cause it to continue to travel upon trackset 11 in the direction indicated by arrow 27. Toy vehicle 12 thereafter continues and traverses the remainder of trackset 11 and loop 15 to again approach gap 21.

It will be apparent to those skilled in the art that regardless of the energy to be imparted to toy vehicle 12 by booster 13, the traversal of trackset 11 to toy vehicle 12 will have caused toy vehicle 12 to lose some of its energy. As a result, toy vehicle 12 has slowed in velocity as it enters gap 21. The rapid rotation of wheel 22 abruptly accelerates toy vehicle 12 to impart sufficient energy for the next travel lap about trackset 11.

Of importance with respect to the present invention is the momentum sensitive forces applied to toy vehicle 12 during this acceleration which restores velocity and energy to toy vehicle 12. By means set forth below in greater detail, toy vehicle 12 senses the momentum change during this acceleration within gap 21 of booster 13 and responds to the abrupt momentum change to provide detection of a complete circuit or lap of trackset 11. As a result, each time toy vehicle 12 passes through booster 13, the momentum sensitive apparatus within toy vehicle 12 described below determines that one more lap has been completed.

Figure 2:
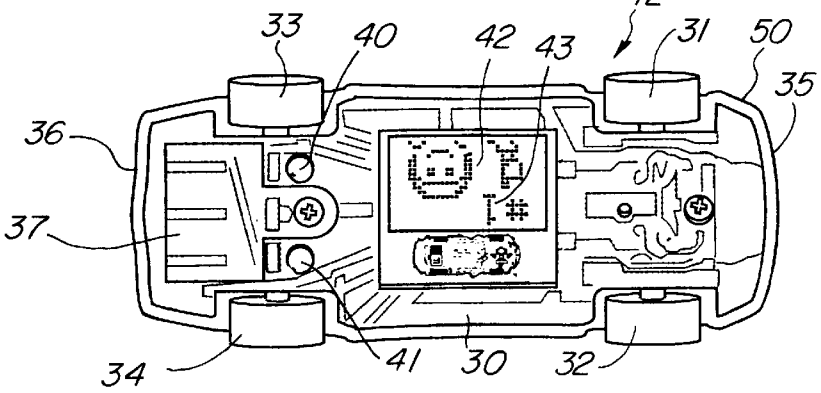
FIG. 2 sets forth a bottom view of the present invention toy vehicle.

FIG. 2 sets forth a bottom view of toy vehicle 12. Toy vehicle 12 includes a chassis 30 supporting a plurality of rotatable wheels 31 through 34 in a freely rolling attachment. Chassis further supports a liquid crystal display 42 having a plurality of symbols such as symbol 43 displayed thereon. Chassis 30 further supports a pair of buttons 40 and 41 and a battery compartment door 37. Door 37 is removable from chassis 30 to facilitate access to a pair of internal batteries 72 and 73 (seen in FIG. 4). Toy vehicle 12 further includes a vehicle body 50 having front bumper 35 and a rear bumper 36 formed thereon. Vehicle body 50 and chassis 30 are preferably fabricated of a molded plastic material or the like and are fitted together in a conventional snap-fit attachment (not shown).

In accordance with an important aspect of the present invention, liquid crystal display 42 is positioned upon the underside of chassis 30 and in accordance with conventional fabrication techniques is capable of displaying various symbols such as the numeric symbol referenced by numeral 43. Liquid crystal display 42 is entirely conventional in fabrication and is driven by a microprocessor 81 (seen in FIG. 5) in further accordance with conventional fabrication techniques. Suffice it to note here that liquid crystal display 42 displays a number (symbol 43) which is incremented by processor 81 each time toy vehicle 12 passes through booster 13 (seen in FIG. 1). Thus, symbol 43 becomes a lap count which is maintained upon liquid crystal display 42 as toy vehicle 12 runs continuously upon trackset 11 (seen in FIG. 1). Of particular importance with respect to the present invention and as is described below in greater detail, chassis 30 supports a momentum switch assembly 60 (seen in FIG. 4) which responds to and is triggered by the momentum change imparted to toy vehicle 12 as it is accelerated by booster 13 (seen in FIG. 1). Of particular advantage in the operation of the present invention toy is the utilization of the momentum change imparted to toy vehicle 12 by the booster to detect the completion of a lap. In contrast to prior art devices which utilize some type of energy depleting counting mechanism, the present invention toy is able to maintain the energy of the vehicle despite the lap counting activity.

Figure 3:
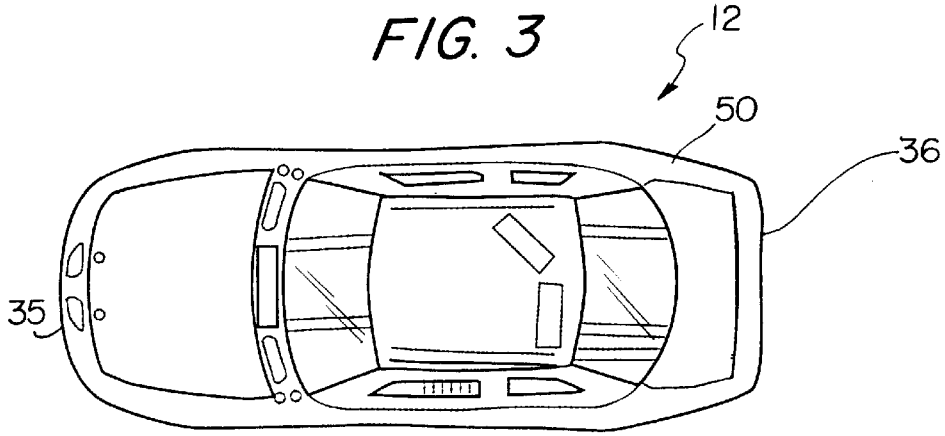
FIG. 3 sets forth a top view of the present invention toy vehicle.

FIG. 3 sets forth a toy view of toy vehicle 12 having body 50 supported upon chassis 30 in the manner set forth below in FIG. 2. Body 50 is preferably formed of a molded plastic material and defines a front bumper 35 and a rear bumper 36. As is also mentioned above, the preferred fabrication of toy vehicle 12 is achieved by fitting body 50 tightly upon chassis 30 (seen in FIG. 2). It will be apparent to those skilled in the art that the aesthetic characteristics of body 50 may be varied to achieve different appearances for toy vehicle 12 without departing from the spirit and scope of the present invention.

Figure 4:
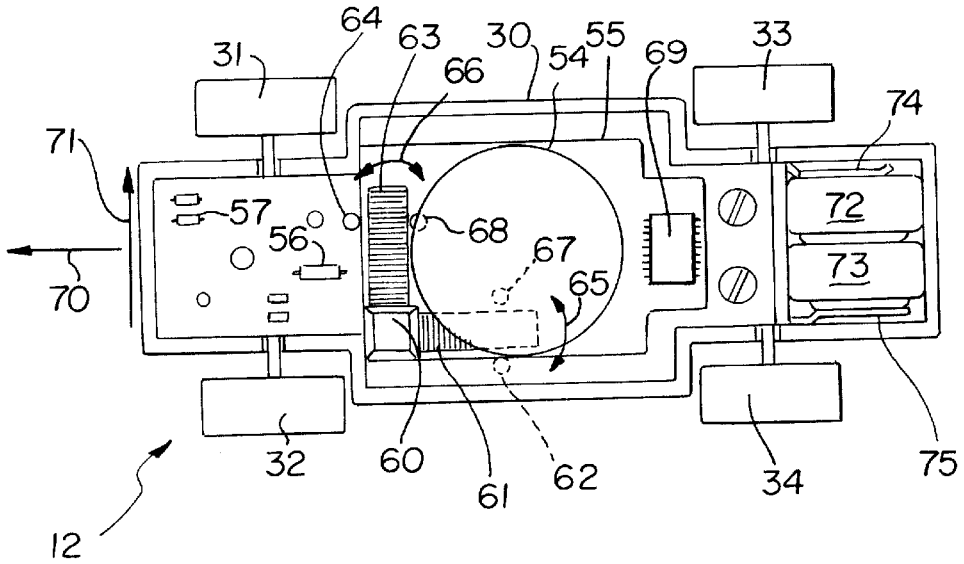
FIG. 4 sets forth a top view of the present invention toy vehicle having the upper body shell removed therefrom.

FIG. 4 sets forth a top view of chassis 30 supported upon wheels 31 through 34 having body 50 of toy vehicle 12 removed therefrom. Chassis 30 is preferably formed of a molded plastic material or the like and supports a printed circuit board 55 which is fabricated in accordance with conventional fabrication techniques. Thus, printed circuit board 55 will be understood to include a plurality of interconnecting conductive paths (not shown) which electrically couple various circuit elements such as elements 56 and 57 to form an operative circuit.

In accordance with the present invention, a momentum switch assembly 60 is secured to and supported by printed circuit board 55. Switch assembly 60 includes a flexible spring contact 61 having a pair of connecting posts 62 and 67 on either side thereof. Similarly, switch assembly 60 includes a flexible spring contact 63 having contact posts 64 and 68 supported on either side thereof. By conventional conductive means upon printed circuit board 55 (not shown), posts 64 and 68 as well as posts 62 and 67 are operatively coupled to the circuit mechanism of microprocessor 81 (seen in FIG. 5). By further use of conventional conductive paths upon circuit board 55, momentum switch assembly 60 is operatively coupled to spring contacts 61 and 63 and provides a lap counter input signal for microprocessor 81 (seen in FIG. 5).

Chassis 30 further supports a pair of batteries 72 and 73 coupled to printed circuit board 55 by a pair of connection terminals 74 and 75 respectively. Batteries 72 and 73 provide operative power for microprocessor 81 and liquid crystal display 42 (seen in FIG. 5).

Chassis 30 further supports a piezoelectric audio output device 54. Device 54 is operatively coupled to printed circuit board 55 by a pair of connecting wires in the manner seen in FIG. 5.

In operation, toy vehicle 12 travels forwardly in the direction indicated by arrow 70 as described above in FIG. 1 and gradually loses energy and gradually slows down as it traverses the trackway loop. During this period in which the kinetic energy of toy vehicle is carrying it about the track, spring contacts 61 and 63 remain relatively steady in their position and thus do not come into contact with either of the posts set beside the spring contact. As a result and as is described below, the lap count displayed upon liquid crystal display 42 (seen in FIG. 5) remains the same. As vehicle 12 approaches booster 13 (seen in FIG. 1), wheel 22 (also seen in FIG. 1) imparts an accelerating force to vehicle 12 in the direction indicated by arrow 70. This accelerating force is abrupt and is applied to toy vehicle 12 for a short duration. This abrupt force causes spring contact 63 to flex in the directions indicated by arrows 66 bringing spring contact 63 into electrical contact with post 68 and post 64 as spring 63 is caused to vibrate back and forth. The electrical connection provided between spring 63 and post 64 or post 68 produces a detecting signal which is utilized by microprocessor 81 to increment the lap count display upon liquid crystal display 42 (seen in FIG. 2). Thus, as toy vehicle 12 repeatedly passes about the trackway circuit and returns to booster 13 (seen in FIG. 1), the accelerating force imparted to toy vehicle 12 disturbs spring contact 63 of momentum switch 60 producing a lap count trigger signal which is applied to processor 81 (seen in FIG. 5).

Chassis 30 further supports a sound synthesizing circuit 69 operatively coupled to piezoelectric audio output device 54. Sound circuit 69 is conventional in fabrication and converts digital signals provided by processor 81 to audio signals suitable for causing output device 54 to "speak" selected messages.

For added flexibility of play value, momentum switch assembly 60 also utilizes spring 61 and post 62 and 67 to respond to side forces upon vehicle 12 in the manner indicated by arrows 71. Thus, in a similar function to spring 63, spring 61 flexes and oscillates in the directions indicated by arrows 65 in response to side forces in the directions of arrows 71. The flexing of spring 61 provides contact between the spring and either or both of contact posts 62 or 67. Thus, toy vehicle 12 is capable of response to side impacts such as crashes or the like to provide an alternative display upon liquid crystal display 42 (seen in FIG. 5).

Figure 5:
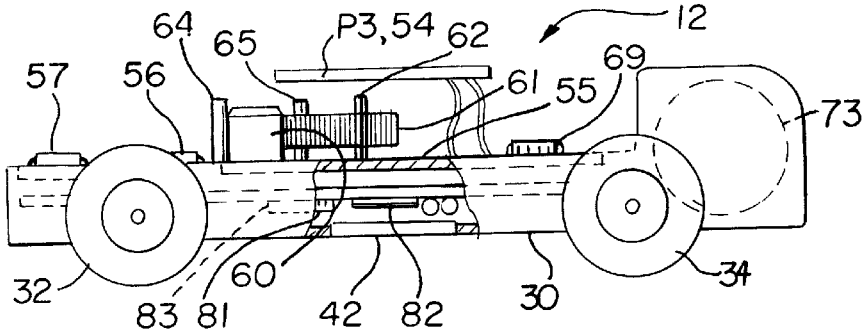
FIG. 5 sets forth a side elevation view of the present invention toy vehicle having the upper body removed therefrom.

FIG. 5 sets forth a partially sectioned side view of toy vehicle 12 having body 50 removed therefrom. As described above, vehicle 12 includes a chassis 30 supported by wheels 32 and 34 and having an internal battery power supply provided by batteries 72 and 73 (battery 72 seen in FIG. 4). Chassis 30 further supports a printed circuit board 55 having a sound circuit 69 supported thereon together with other electronic circuit components such as components 56 and 57. A momentum switch assembly 60 is secured to and electrically coupled to printed circuit board 55. Switch assembly 60 includes spring contacts 61 and 63 (spring 63 seen in FIG. 4). As described above in FIG. 4, spring contact 63 is positioned between contact posts 64 and 68 while spring contact 61 is positioned between contact posts 62 and 67.

Chassis 30 further supports a printed circuit board 80 having a plurality of electronic circuit components supported thereon. Thus, printed circuit board 80 supports a microprocessor 81 having an associated memory 83 together with a display driver 82. Microprocessor 81 and memory 83 operate in accordance with a conventional instruction set which provides a counter type function in accordance with conventional fabrication techniques. By means not shown but in accordance with conventional fabrication, momentum switch assembly 60 produces an input signal to microprocessor 81 each time spring contacts 61 or 63 are sufficiently disturbed to touch a nearby contact post. As a result, switch assembly 60 is able to respond to both side-to-side forces and forwardly directed forces imparted by booster 13 (seen in FIG. 1). Of importance with respect to the present invention is the operation of processor 81 and memory 83 when triggered by momentum switch assembly 60 to increment the numeric value applied to display driver 82. Display driver 82 is fabricated in accordance with conventional fabrication techniques and, by means not shown, is operatively coupled to liquid crystal display 42.

Thus, it will be understood that the combination of processor 81, memory 83, display driver 82 and liquid crystal display 42 operate as a conventional counter and display of the type well known in the art. Further, it will be understood that momentum switch assembly 60 provides the input signal which causes the resulting counter to increment the display numeral upon liquid crystal display 42.

To provide further interest and entertainment value for toy vehicle 12, processor 81 is preferably configured to supply a digital signal to sound circuit 69 each time the lap counter is incremented causing sound circuit 69 to audibilize a corresponding number using output device 54. Thus, in the preferred fabrication of the present invention, each time toy vehicle 12 passes through booster 13 (seen in FIG. 1), the lap count displayed upon liquid crystal display 42 is incremented and the number corresponding to the new lap number is audibilized to be heard by the user.

What has been shown is a toy having a toy vehicle and trackset in which the momentum forces induced by the action of the trackway booster are utilized to provide a lap count increment. The lap-counting process is completely free of energy drain from the toy vehicle and, as a result, does not impede the velocity or acceleration of the vehicle. The electronic circuitry operative to provide the lap count in response to the momentum switch and to display the lap count while audibilizing it is entirely conventional in fabrication.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle and trackset combination, said toy vehicle and trackset comprising:

a toy vehicle having a chassis and rolling wheels;

a momentum switch supported upon said chassis responsive to momentum change forces imparted to said toy vehicle;

display means supported by said toy vehicle for displaying a lap count number;

circuit means supported by said toy vehicle responsive to said momentum switch for incrementing said lap count number each time said momentum switch is triggered;

a trackset having a toy vehicle guiding pathway forming a closed circuit; and a booster within said trackset having means for accelerating said toy vehicle as is passes through said booster, said booster imparting an abrupt momentum change to said toy vehicle to accelerate said toy vehicle and trigger said momentum switch.

2. The toy vehicle and trackset combination set forth in claim 1 wherein said chassis defines an undersurface and wherein said display means are supported on said chassis to be viewable from said undersurface.

3. The toy vehicle and trackset combination set forth in claim 2 wherein said booster includes a gap which said toy vehicle traverses and at least one rotating disk for engaging said toy vehicle to accelerate said toy vehicle and wherein said momentum switch responds to acceleration of said toy vehicle.

4. The toy vehicle and trackset combination set forth in claim 3 wherein said circuit means includes sound means for producing an audible output following triggering of said momentum switch.

5. The toy vehicle and trackset combination set forth in claim 4 wherein said momentum switch is also responsive to side-to-side impacts.

6. The toy vehicle and trackset combination set forth in claim 1 wherein said booster includes a gap which said toy vehicle traverses and at least one rotating disk for engaging said toy vehicle to accelerate said toy vehicle and wherein said momentum switch responds to acceleration of said toy vehicle.

7. The toy vehicle and trackset combination set forth in claim 6 wherein said circuit means includes sound means for producing an audible output following triggering of said momentum switch.

8. The toy vehicle and trackset combination set forth in claim 6 wherein said chassis defines an undersurface and wherein said display means are supported on said chassis to be viewable from said undersurface.

9. The toy vehicle and trackset combination set forth in claim 8 wherein said momentum switch is also responsive to side-to-side impacts.

* * * * *